US005947700A

United States Patent [19]

McKain et al.

[11] Patent Number: 5,947,700

[45] Date of Patent: Sep. 7, 1999

[54] FLUID VACUUM SAFETY DEVICE FOR FLUID TRANSFER SYSTEMS IN SWIMMING POOLS

[76] Inventors: Paul C. McKain, 3300 NW. 97th Ave., Sunrise, Fla. 33351; David Rizzi, 3613 Loquat Ave., Miami, Fla. 33133; Mark Fritze, 558 Lakeside Cir., Sunrise, Fla. 33326

[21] Appl. No.: 08/901,849

[22] Filed: Jul. 28, 1997

[51] Int. Cl.[6] ..... F04B 49/02; F04B 49/10

[52] U.S. Cl. ..... 417/306; 417/300; 417/63; 417/17; 417/44.9; 4/541.2

[58] Field of Search ..... 417/63, 300, 306, 417/17, 44.9; 4/541.2

[56] References Cited

U.S. PATENT DOCUMENTS

| | | | |
|---|---|---|---|
| 2,716,506 | 8/1955 | Fike | 220/89 |
| 4,481,008 | 11/1984 | Kurtz | 604/118 |
| 4,602,391 | 7/1986 | Shepherd | 4/542 |
| 4,620,835 | 11/1986 | Bell | 417/17 |
| 4,861,231 | 8/1989 | Howard | 417/38 |
| 5,167,041 | 12/1992 | Burkitt, III | 4/541.2 |
| 5,304,127 | 4/1994 | Kawahara et al. | 604/65 |
| 5,347,664 | 9/1994 | Hamza et al. | 4/509 |
| 5,499,406 | 3/1996 | Chalberg et al. | 4/541.2 |
| 5,570,481 | 11/1996 | Mathis et al. | 4/541.2 |
| 5,682,624 | 11/1997 | Chiochetti | 4/509 |
| 5,725,359 | 3/1998 | Dongo | 417/44.9 |

*Primary Examiner*—Timothy S. Thorpe
*Assistant Examiner*—Ehud Gartenberg
*Attorney, Agent, or Firm*—Robert M. Downey, P. A.

[57] ABSTRACT

A safety device for use in a fluid transfer system for a swimming pool or similiar application, having a pump which draws water from a reservoir through one or more intake lines each extending from an open end at the reservoir to the pump intake. The device analyzes negative pressure levels in the system and, upon detecting a negative pressure level being outside of a selected operational range, the device deactivates the pump and triggers a vacuum breaker device to eliminate negative pressure in the system, by introducing air from atmosphere into the intake lines thereby removing suction at the open ends of the intake lines. The safety device may further activate warning devices including audible and visible alarms to indicate that the system has been deactivated.

6 Claims, 8 Drawing Sheets

130
134
137
136
138
139
R1
R2
R3
R4
R5
R6
R7
R8
R9
IC1
IC2
SW1
SWITCH BANK
I1
INDICATORS
RP1
RESISTORS
OUTPUT
INPUT

FLUID VACUUM SAFETY DEVICE FOR FLUID TRANSFER SYSTEMS IN SWIMMING POOLS

BACKGROUND OF THE INVENTION

1. Field of the Invention

The present invention relates to a safety device for fluid transfer systems and, more particularly, to a safety device operable in response to detection of a predetermined negative pressure level in one or more intake lines of a fluid transfer system to eliminate a vacuum therein, thereby removing a suction force at the open ends of the intake lines.

2. Description of the Related Art

Drowning is the second leading cause of unintentional injury related deaths to children 14 years old and younger. While most drownings occur in swimming pools, a surprising fact is that in many swimming pool and hot tub drownings (both adults and children), the main culprit is the water circulation system. In a typical pool, the circulation system includes a main drain suction intake line and at least one skimmer suction intake line, both of which feed into a main intake line that leads to a pump. A return line directs water flow back into the pool.

Most people do not feel threatened by a pool's circulation system, including the main drain intake on the bottom of the pool, and the skimmer boxes along the side of the pool. However, if a person comes into contact with any of the suction intake lines of the circulation system (at either the main drain or skimmer intakes) causing the suction intake to be covered or obstructed, the immense suction of the pump forms an instant seal between the open end of the suction intake line and the person's skin or clothing. This may result if a person places their hand over the open end of the suction intake line or, as often happens with children, a person sits down on the suction intake. In either case, the force needed to pull them free often exceeds 800 pounds. Moreover, the injuries which are inflicted in a matter of a few seconds are horrific, usually permanent and sometimes fatal. If a person, especially a child, is sucked onto the main drain suction intake on the bottom of the pool, they usually drown.

The only way to free a person sucked onto the intake of a circulation system of this type, without causing severe injury or dismemberment, is to interrupt or disable the source of the suction force, i.e., the pump. This can be done by interrupting power to the pump. However, even if the pump is shut down, a vacuum will remain in the intake side of the system between the pump and the obstructed end of the suction intake line. Nonetheless, a victim could still be freed with some assistance, causing minor injuries. Ideally, if the vacuum in the intake line can be quickly eliminated after a victim becomes stuck to the intake, the victim will be freed with little or no assistance and without injury.

In most instances wherein a victim becomes stuck to an intake of a circulation system, typically in a swimming pool or hot tub, rescuers fail to realize the need to immediately shut off the pump. Instead, in a panic, people tend to go to the victim and attempt prying them free. In the rare instance this is successful, the injuries are often severe and permanent. Of course, there are also instances wherein there are no other people present to come to the victim's rescue. These situations are almost always fatal.

The imminent danger presented by fluid circulation systems of the type commonly found in swimming pools, hot tubs, and the like has been longstanding in the art. Little, if any, attention has been given to providing a satisfactory solution to this deadly problem that exists in every swimming pool, hot tub, as well as all other fluid circulation systems wherein a fluid is drawn from a reservoir through one or more suction intakes by a pump. Accordingly, there has been and there remains an urgent need to provide an effective means of preventing death and injury to those otherwise unfortunate victims who become unexpectedly attached by suction to the intake of a fluid circulation system.

SUMMARY OF THE INVENTION

The present invention is directed to a device for use in a fluid transfer system of the type including at least one pump which draws water from a reservoir through one or more intake lines each extending from an open end at the reservoir to an intake of the pump. The primary purpose of the invention is to save lives and property by alleviating the intense vacuum that builds when one or more of the suction intake ports of a pump assisted fluid circulation system becomes obstructed. The safety device includes means for analyzing negative pressure levels sensed in the fluid transfer system. Upon detecting a negative pressure level being outside of a normal operational range, vacuum pressure relief means are actuated for eliminating negative pressure in the system, thereby removing suction at the open ends of the intake lines. The device may further disable the pump, shutting it off, upon detecting the abnormal negative pressure level. Warning devices, including audible and visible alarms, may be provided to indicate that operation of the fluid transfer system has been interrupted. This is especially useful to alert users to the possible occurrence of an obstruction of the intake lines by a person or object and the need to inspect and reset the device prior to reactivating the fluid transfer system. Other options can also be made available, including an automatic pump shutdown, remote alarms, visual indicators, and the like.

OBJECTS AND ADVANTAGES OF THE INVENTION

With the foregoing in mind, it is a primary object of the present invention to provide a safety device for use in a fluid transfer/circulation system, wherein the device is structured to eliminate negative pressure in the system upon detecting a negative pressure level being outside of a selected operational range, thereby removing suction at the open ends of the intake lines.

It is a further object of the present invention to provide a safety device which is particularly useful in the fluid circulation systems of swimming pools, hot tubs and the like for preventing death and injury to persons or animals which become attached by suction to the intake openings of the system.

It is still a further object of the present invention to provide a safe, reliable and relatively inexpensive safety device for easy installation to existing fluid transfer/circulation systems and which is structured to eliminate negative pressure in the system upon detecting a negative pressure level being outside a predetermined range, thereby removing suction at the open ends of the intake lines.

It is still a further object of the present invention to provide a reliable, relatively inexpensive safety device for use in a fluid transfer/circulation system of the type including at least one pump which draws water from a reservoir through one or more intake lines, wherein the device is structured to deactivate the pump(s) and to further eliminate negative pressure in the system upon detecting a negative pressure level in the system being outside of a predetermined range.

It is still a further object of the present invention to provide a safety device, as described above, further including warning devices such as, but not limited to, audible and visible alarms, to indicate that the safety device has been triggered to eliminate negative pressure in the intake lines of a fluid transfer system.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

The present invention is directed to a fluid vacuum safety device 50 for use in a pump assisted fluid circulation system for the purposes of alleviating an intense vacuum that builds in the system when one or more of the suction intake ports of the circulation system become obstructed.

Figure 6:
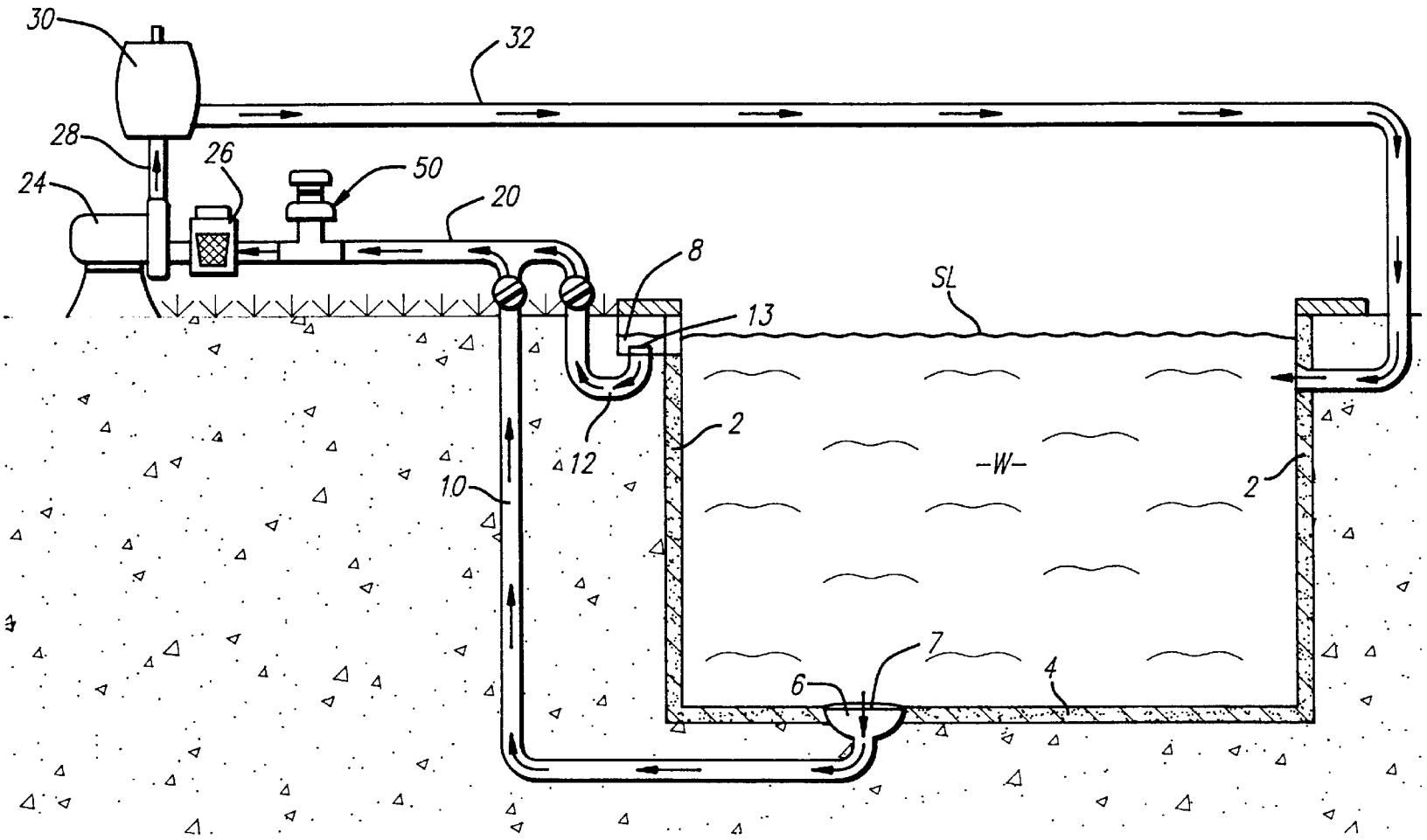
FIG. 6 is an elevational view, in partial section, illustrating a typical fluid circulation system for circulating fluid in a reservoir, such as a swimming pool, hot tube or the like, showing the safety device of the present invention installed in-line on a main suction intake line of the system, between the intake of the system's pump and suction intake openings in the swimming pool.

Referring to FIG. 6, a typical fluid circulation system of the type commonly found in swimming pools and hot tubs is shown. A reservoir of water W is contained within a structure having side walls 2 and a bottom 4. A main drain 6 having a drain cover grating is provided on the bottom 4. At least one skimmer box 8 is provided along one or more of the side walls 2 at the water surface level SL. A drain suction intake line 10 leads from the main drain 6 to a main suction intake line 20. A skimmer suction intake line 12 has an open end 13 in the skimmer box 8 which is maintained below the water surface level SL. The skimmer suction intake line 12 feeds into the main intake line 20. The main intake line 20 is directed to a pump 24 which may have a screen trap 26 connected to the main intake line 20, just prior to the intake of the pump 24. A main output line 28 leads to a filter 30. One or more return lines 32 extend from the filter 30 back to the water reservoir W to return water that is circulated through the system back to the reservoir W.

FIG. 6 shows the fluid vacuum safety device 50 properly installed in-line along the main suction intake line 20 of the circulation system, prior to the intake of the pump 24 and screen trap 26. If an object or person is caused to be sucked onto one of the open ends of the suction intakes, such as the open end 13 of the skimmer suction intake 12, the drain plate 7 or, if the drain plate is removed, the drain suction intake line 10 at the main drain 6, a vacuum will instantly develop throughout the intake lines, including the main suction intake line 20. The fluid vacuum safety device 50 is designed to react to this situation to immediately eliminate the vacuum in the system and, accordingly, the suction force at the open ends of each of the suction intake lines, including the skimmer suction intake 13 and the main drain intake 6. Upon reaching a predetermined vacuum level, which happens quite rapidly when one of the intakes becomes obstructed, the fluid vacuum safety device 50 causes air from atmosphere to be rapidly introduced into the main intake line 20 and throughout the other intake lines, thereby removing all suction force at the open suction intake ends 13 and 16 in the reservoir W. The air introduced into the system interrupts the prime of the pump 24, thereby eliminating any further source of suction.

Figure 1:
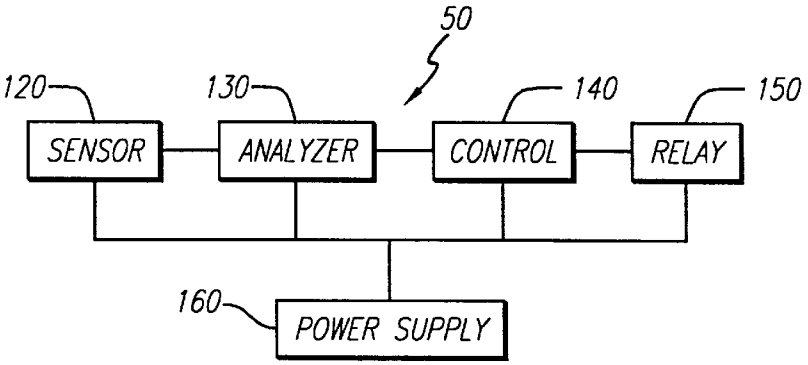
FIG. 1 is a block diagram illustrating the primary components of the safety device and their functional interrelationship, in accordance with a first preferred embodiment of the present invention.

Referring to FIGS. 1–5, a first preferred embodiment of the present invention is shown. The principal components of the fluid vacuum safety device 50 are shown in FIG. 1 and include a sensor circuit 120 which senses the vacuum level in the fluid circulation system. The output of sensor circuit 120 is applied to an analyzer circuit 130 that allows the selective setting of a particular vacuum level (a predetermined vacuum level) by control circuit 140 that will define a trip point or emergency condition in the system. The analyzer circuit output is applied to the control circuit 140 for further processing and control of operational relays or contactors 150. An isolated power supply 160 furnishes voltage for the circuitry.

Figure 2:
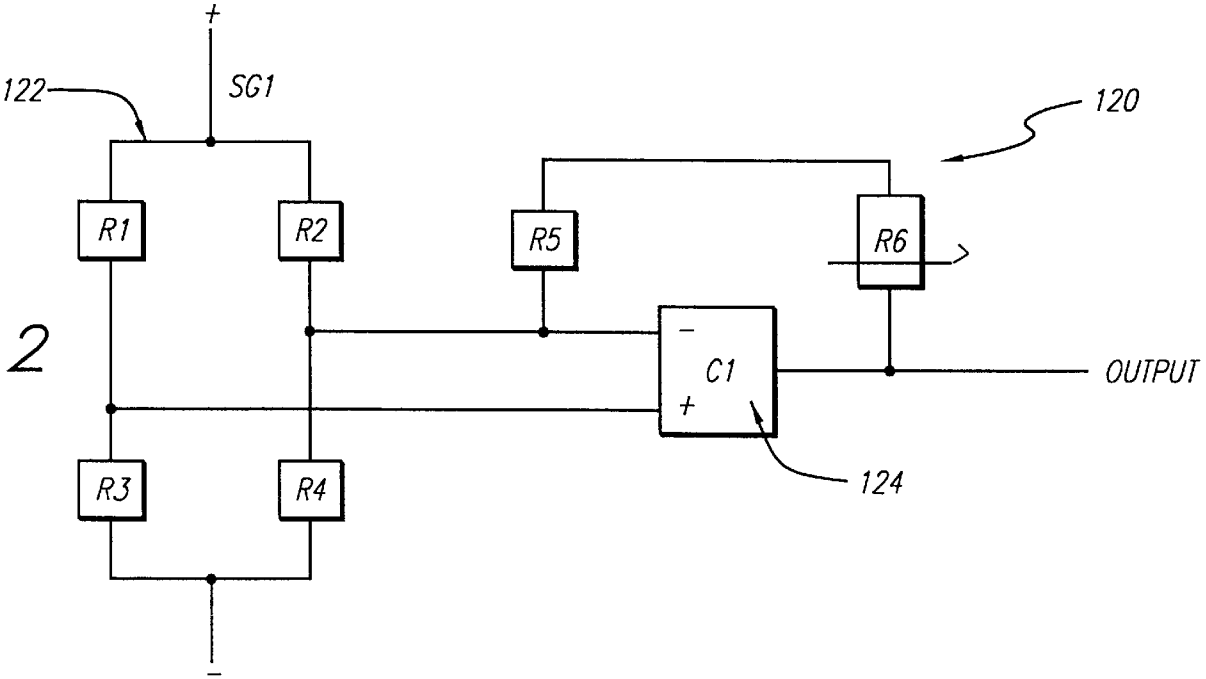
FIG. 2 is a circuit diagram of the sensor of the embodiment of FIG. 1.

The sensor circuit 120 is depicted in FIG. 2 and utilizes a strain gauge 122 (SG1) to sense the vacuum in the pump return line 20. The four internal elements, R1, R2, R3, and R4, in the strain gauge 122 form a bridge circuit. At 0" of mercury vacuum pressure, the bridge circuit 122 is balanced and the output of the bridge is 0, with the junction of R1/R3 being equal to the junction R2/R4. The output of the junctions are applied to the inputs of IC1, an operational amplifier 124. When the bridge is balanced, the output of the operational amplifier 124 is approximately one-half the power supply voltage. As vacuum increases, the bridge becomes unbalanced and the R1/R3 and R2/R4 junctions change voltage levels in a direct relationship to vacuum pressure level in the system. This small change in voltage is amplified by the operational amplifier 124 and provides a useable level for the analyzer circuit 130. Resistor R5 sets the minimum gain of the operational amplifier, while the adjustable resistor R6 sets the maximum gain. The ability to control gain is necessary due to the wide variations of vacuum levels found in different systems. In a preferred embodiment, the operational amplifier 124 is a type 741 IC.

Figure 3:
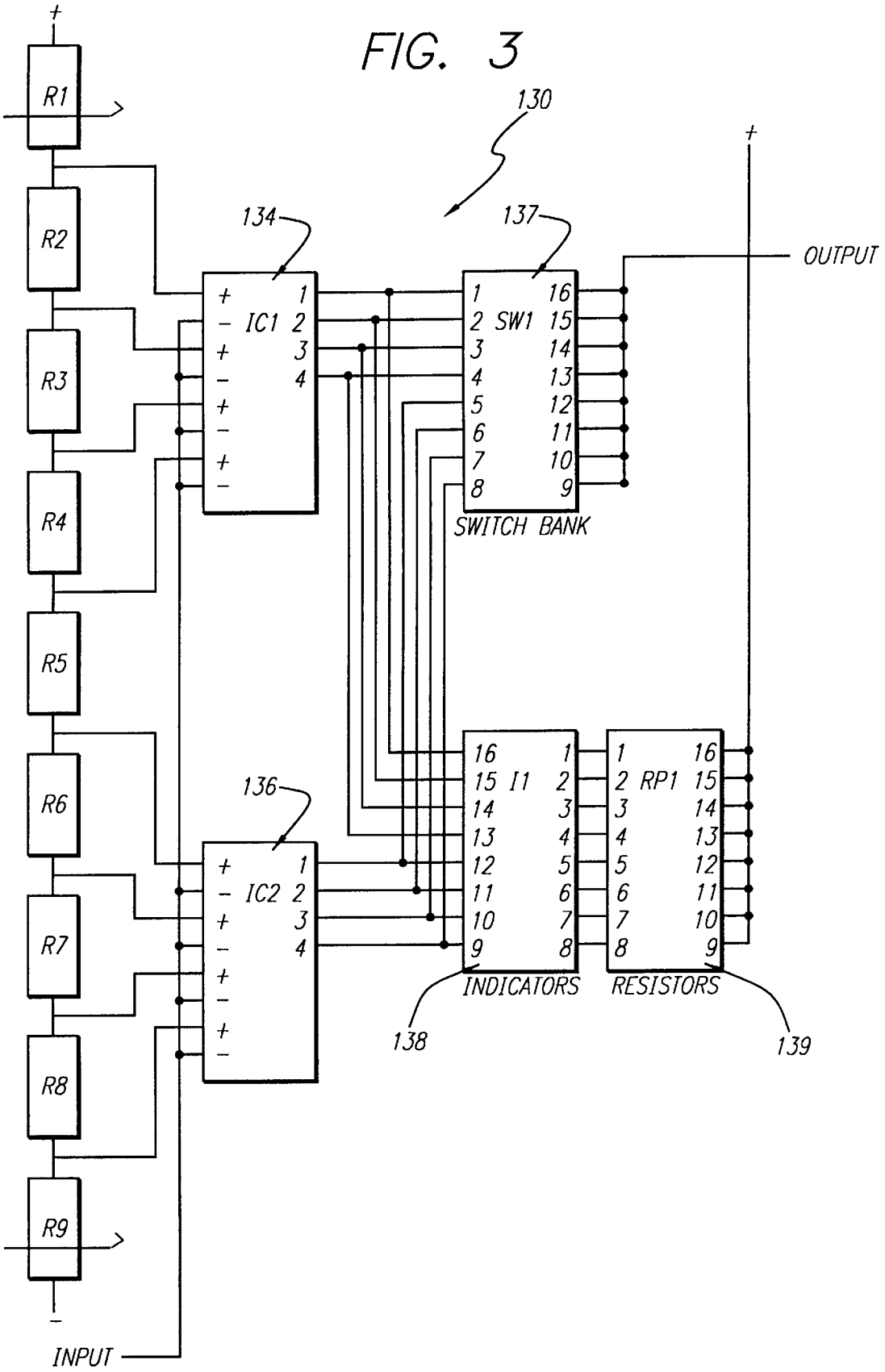
FIG. 3 is a circuit diagram of the analyzer of the embodiment of FIG. 1.

The analyzer circuit 130, as shown in FIG. 3, contains a resistor ladder network 132 composed of resistors R1–R9. Both R1 and R9 are variable resistors. Resistors R2–R8 are all equal value resistors. In this manner, a high point and a low comparator point can be set via the R9 and R1 resistors, respectively, leaving six other equally valued comparator points between the high and low points. The voltages derived from this ladder network 132 are applied to the positive inputs of the comparator circuits 134 (IC1) and 136 (IC2). The output of the sensor circuit 120 is applied to the negative inputs of the comparators 134, 136. The normal output of the sensor circuit 120 is approximately one-half of the supply voltage. R9 is adjusted so that the positive input of comparator 136 is slightly above the steady state output of the sensor circuit 120. Under these conditions, the comparators are in the off state and their outputs are high.

As vacuum is applied to the sensor circuit 120, the output voltage will increase in a linear manner. The voltage increase is applied to the negative inputs of all eight comparator circuits of 134 and 136. As the voltage increases, the first comparator at the junction of R8 and R9 will go into conduction. As the increase continues, each of the comparators will act in a like manner. If the voltage continues to increase to its design maximum, all eight comparator circuits will be conducting. Any comparator that is conducting will have a low output. The comparators have an open collector output circuit and each is connected to the power supply 160 via an LED 138 and series current limiting resistor 139 (RP1). This condition will cause the LED connected to each individual comparator to illuminate and indicate the level of vacuum reached.

The output of each comparator is also connected to a SPST switch contained in the switch bank 137 (SW1). These switches each represent one of the eight comparator circuits. The switch that is connected to the comparator representing the preselected level of vacuum at which corrective action is desired is placed in the "ON" position, and the output of the comparator is connected to the output line of the analyzer 130. In this manner, an alarm condition will be achieved whenever the preset vacuum level is attained.

The single switch that is selected as the trip level will always be illuminated since the LED that corresponds to the selected level is connected to that switch and current will flow through the resistor contained in 139, the LED contained in 138, the switch contained in 137, and the input voltage clamp circuitry contained in the control circuitry 140, described hereinafter.

The sensor circuit 120 and the analyzer circuit 130 require a power supply voltage that is slightly higher than that required for the control circuitry 140. This requires that the output of the analyzer circuit 130 be clamped at the maximum level of the input voltage allowed by the circuitry of the control circuit 140. A clamp diode is utilized at the input of the control circuit 150 and completes the current path that allows the illumination of the selected switch on the switch bank 137.

Figure 4:
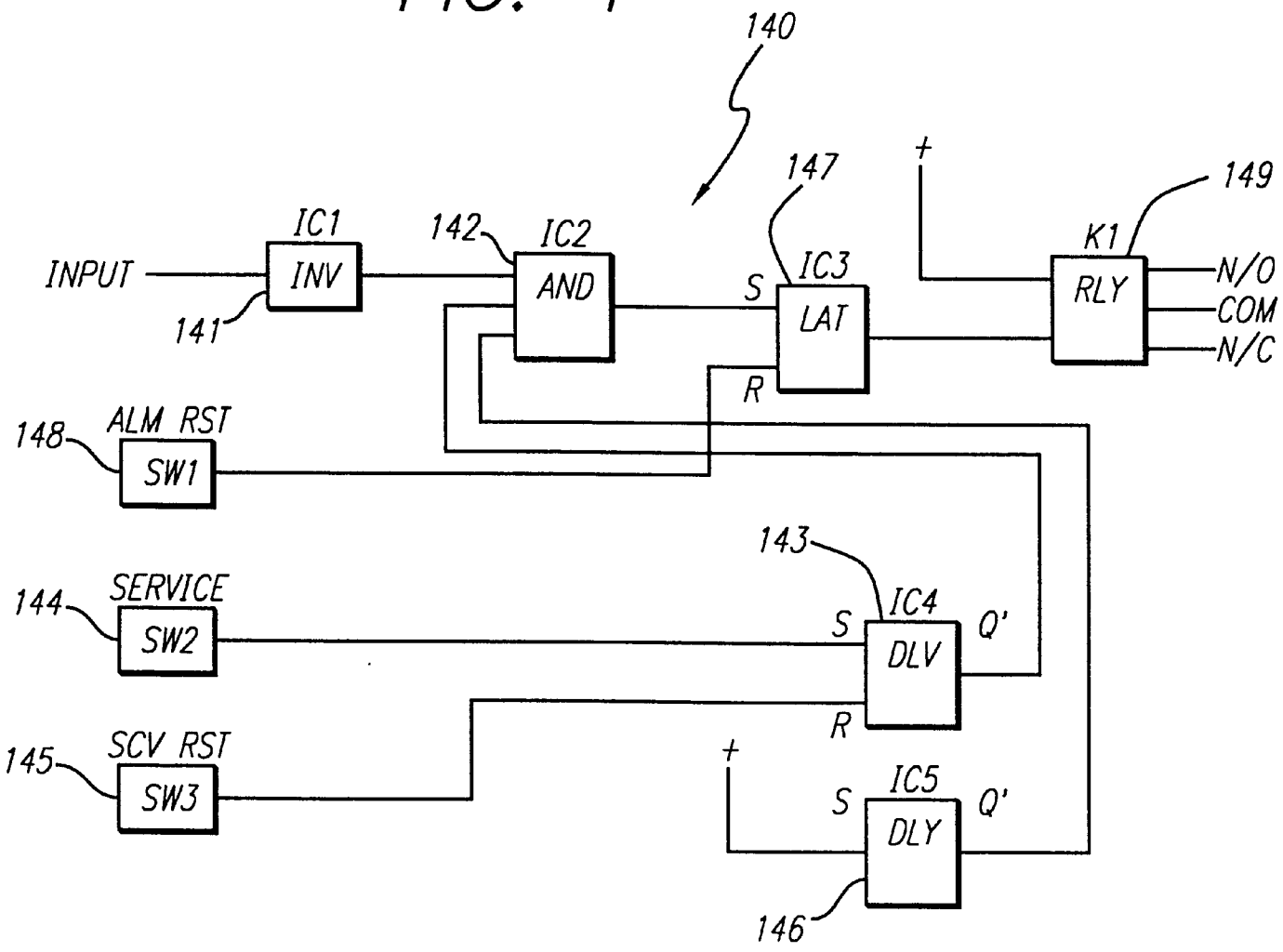
FIG. 4 is a circuit diagram of the control and relay components of the embodiment of FIG. 1.

Referring to FIG. 4, the control and relay circuitry 140 is shown, in accordance with the first preferred embodiment of the fluid vacuum safety device 50. The input signal to the control circuitry 140 is the output of the analyzer circuit 130 and is applied to an inverter 141 to generate a true or high signal under an alarm or off-normal condition. The output of the inverter 141 is connected to a three input AND gate 142. The second input to this AND gate 142 is the Q' output of the service timer 143. The service timer 143 is a 555 type timer and is set by the momentary activation of the service switch 144. When this switch 144 is activated, the set input to timer 143 starts the timer cycle. This makes the Q' output of the timer 143 FALSE and applies a FALSE to the AND gate 142. In this manner, any signal from the analyzer circuitry 130 is negated while in the service mode. When service is completed, the service person should momentarily activate the "SERVICE RESET" switch 145 which will activate the timer 143, reset circuitry, and restore normal conditions to the system. If the switch 145 is not pressed/activated, the timer 143 will time out and normal operation will be restored after a predetermined period of time.

The third input to the AND gate 142 is connected to another timer 146 which is also a 555 type timer. This particular timer 146 is started when power is turned on and applied to the device 50. The Q' output of this timer 146 holds off the AND gate 142 for a short duration when the system initially starts in order to allow the pump of the fluid circulation system to reach prime. At the end of this duration, two of the AND inputs are in a true state. This is a normal operation. If an alarm condition should be encountered, the alarm input to the AND gate will go true. With all three inputs true, the output of the AND gate 142 will go true and activate the set input to the latch 147. The latch 147 remains in a set state until it is manually reset via the alarm reset switch 148. When the latch 147 is set, the relay 149 is activated and the normally closed (N/C) contacts open. This drops the power to the contactor that allows the pump of the circulation system to run. At the same time, the normally open (N/O) contacts close and provide power to operate the vacuum breaker 170 (see FIG. 5) which will allow the release of any object held to the open ends of the intake lines (return lines) leading from the reservoir W to the pump 24. Once this happens, the pump 24 cannot be restarted until the alarm reset switch 148 is activated. It should be noted at this point that the device 50 can be configured with additional relay contacts to allow the use of various warning devices and indicators which are activated at the preset vacuum pressure level (alarm condition).

Figure 5:
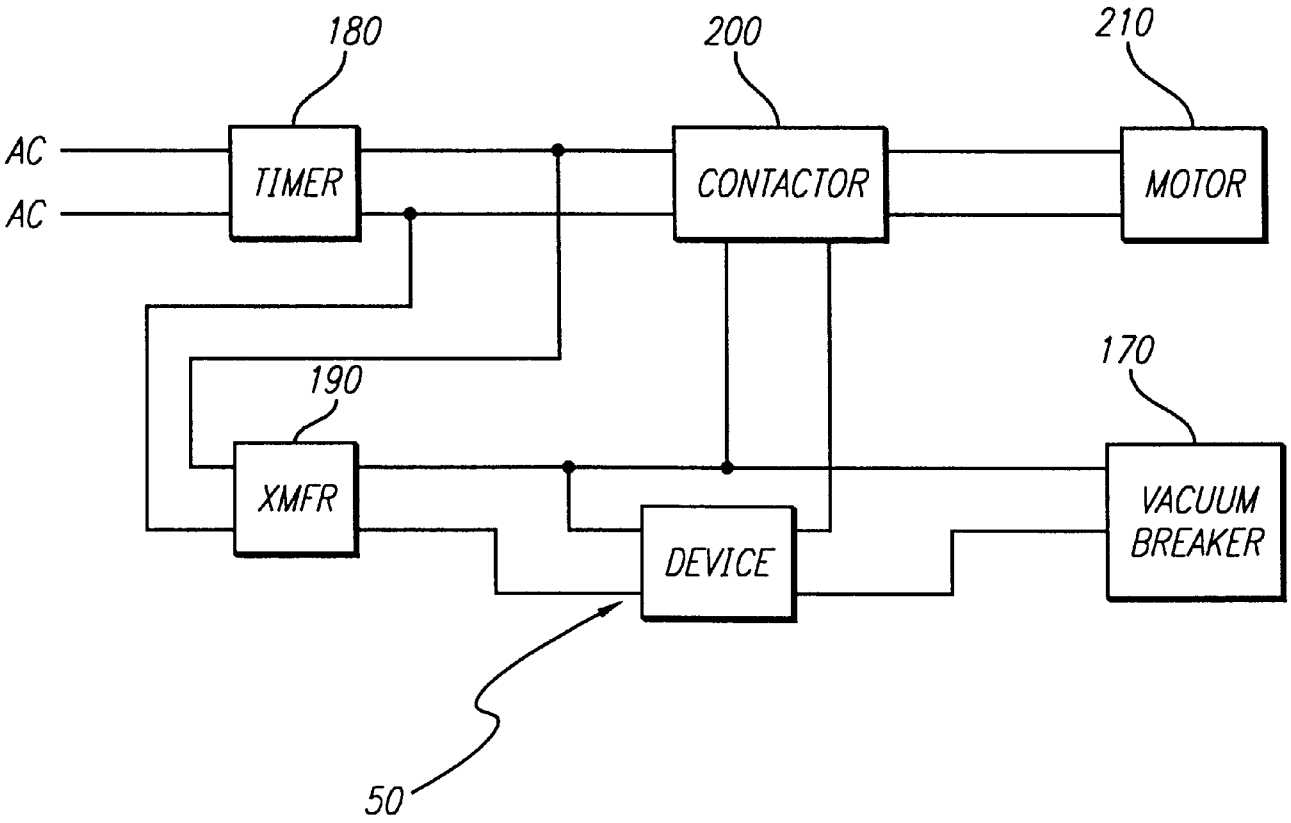
FIG. 5 is a schematic diagram illustrating interconnection of the safety device of FIG. 1 to a fluid transfer/circulation system of the type commonly used in swimming pools and hot tubs.

Referring to FIG. 5, the device 50, in accordance with the first preferred embodiment, is shown wired along with a vacuum breaker 170 to other components of a fluid circulation system. The diagram of FIG. 5 is representative of a preferred configuration of components for use in the fluid circulation system of swimming pools and hot tubs. In FIG. 5, the fluid vacuum safety device 50 is shown wired to the vacuum breaker 170 and other components. When the timer 180 of the system goes active, power is applied to the transformer 190, which supplies low voltage AC to the safety device 50. One side of the low voltage AC is also supplied to the contactor 200 and the vacuum breaker 170. If conditions are normal, the low voltage AC circuit will be completed to the contactor 200 which will allow the motor 210 of the pump 24 to run. Once the initial time period for pump start-up is complete, the safety device 50 monitors operating conditions. If an off-normal condition is encountered, the safety device 50 will break the circuit to the contactor 200 and complete the circuit to the vacuum breaker 170, thereby introducing air from atmosphere into the suction intake lines (return lines) of the system and eliminating vacuum pressure between the pump 24 and open ends of the suction intake lines. This state will be maintained until the device 50 is manually reset after the off-normal condition has been cleared. With the incorporation of additional contacts, other indicators or warning devices can be added.

Referring now to the remaining drawing figures, the fluid vacuum safety device is shown in accordance with an alternative embodiment and is indicated as 50'. The safety device 50' includes a base unit 52 defined primarily by an inverted T-section formed of PVC having a main through passage 54 defined along the bottom of the inverted T and having opposite open ends 55, 55' which connect in-line to the main intake line 20, as seen in FIG. 6. During normal operating conditions, water flow will travel in the direction of the arrow 56 in the through conduit 54 towards the pump 24.

The inverted T-section of the base unit 52 further includes an upwardly extending vent port 60 extending upwardly from the through passage 54, in fluid communication therewith, to a top open end 62. The top open end 62 is surrounded by an annular flange 64 having an O-ring seal 67 fitted to a top face 68.

A frangible membrane 70 rests on the O-ring 67 in covering relation to the open top 62 of the vent port 60. The frangible membrane 70 may be provided with an increased thickness about its outer periphery, defining a surface engaging rim 72. The central zone 74 within the surrounding rim 72 extends across and completely covers the open top 62 of the vent port 60 and is of a reduced thickness relative to the rim 72. The frangible membrane 70, and particularly the central zone 74, may be formed of glass or other materials having shattering or disintegrating characteristics. The thickness of the central zone 74 of the frangible membrane 70 will vary depending upon both the desired predetermined negative pressure at which the frangible membrane is caused to implode and disintegrate, as well as the diameter of the opening 62 which the central zone 74 covers and the material characteristics of the membrane. Nonetheless, the central zone 74 is thin (in most instances less than ⅛" thick) and will implode and disintegrate in response to the suction force (indicated by the arrow 76) as occurs when one or more suction intakes become obstructed.

The ideal vacuum pressure at which the frangible membrane 70 disintegrates is approximately 20 in. Hg. When the frangible membrane 70 is caused to disintegrate, as a result of the suction force of the vacuum condition in the through passage 54 and vent port 60, air from atmosphere is able to quickly enter through the open top 72 to fill the intake lines of the fluid circulation system, thereby eliminating the vacuum.

Figure 7:
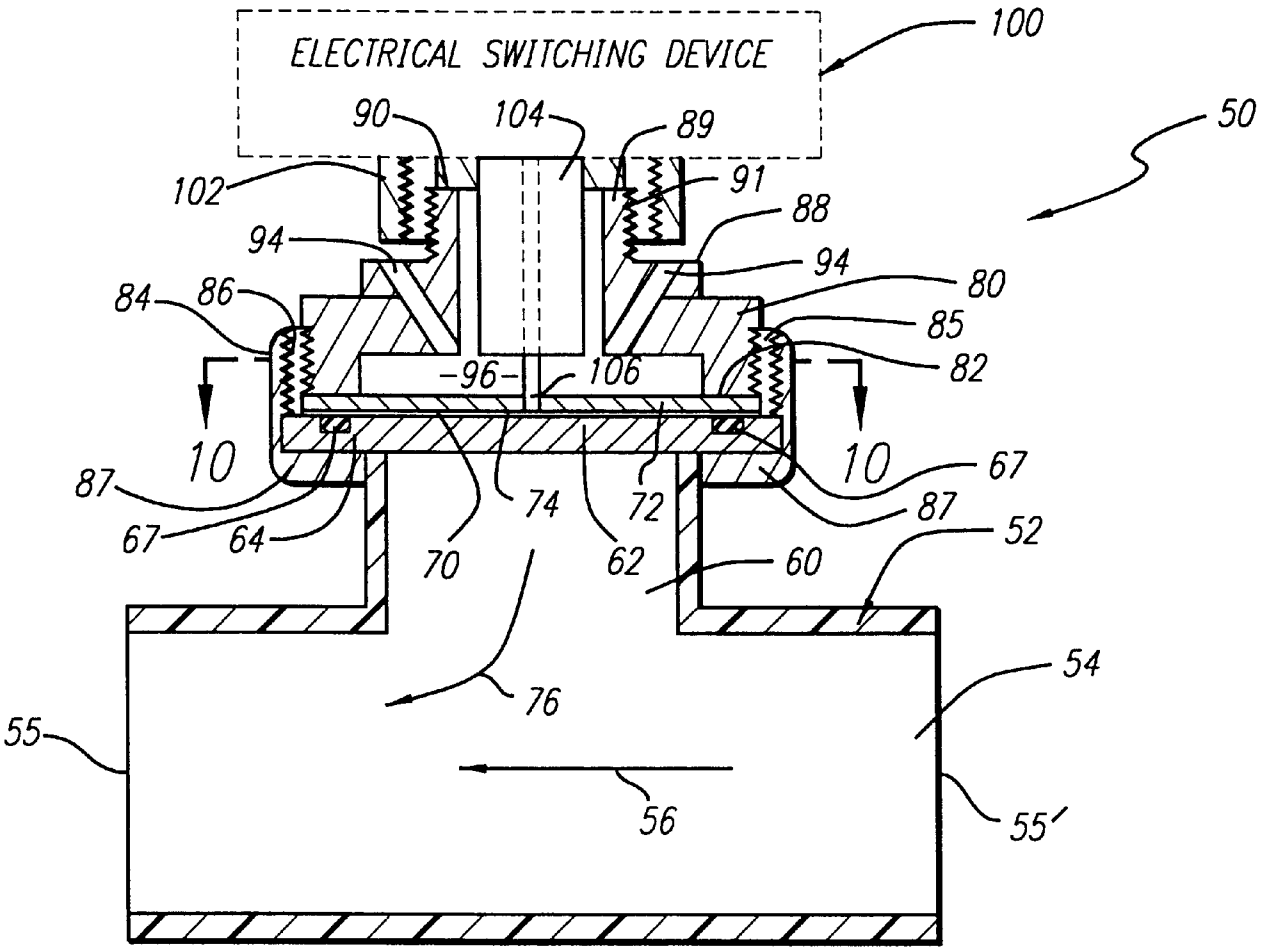
FIG. 7 is an elevational view, in partial section, illustrating an alternative embodiment of the safety device of the present invention.
Figure 8:
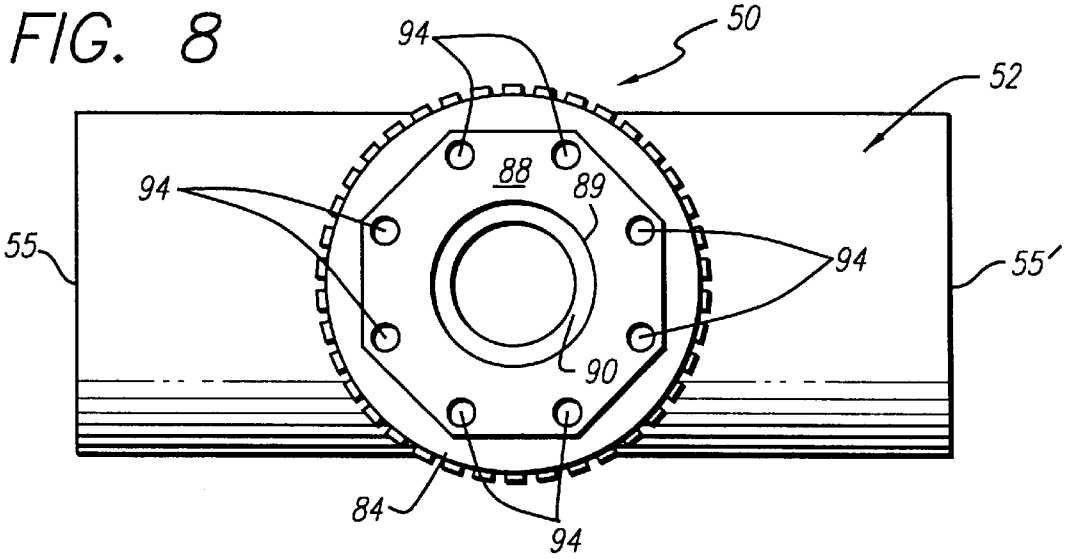
FIG. 8 is a top plan view of the safety device of the embodiment of FIG. 7.
Figure 10:
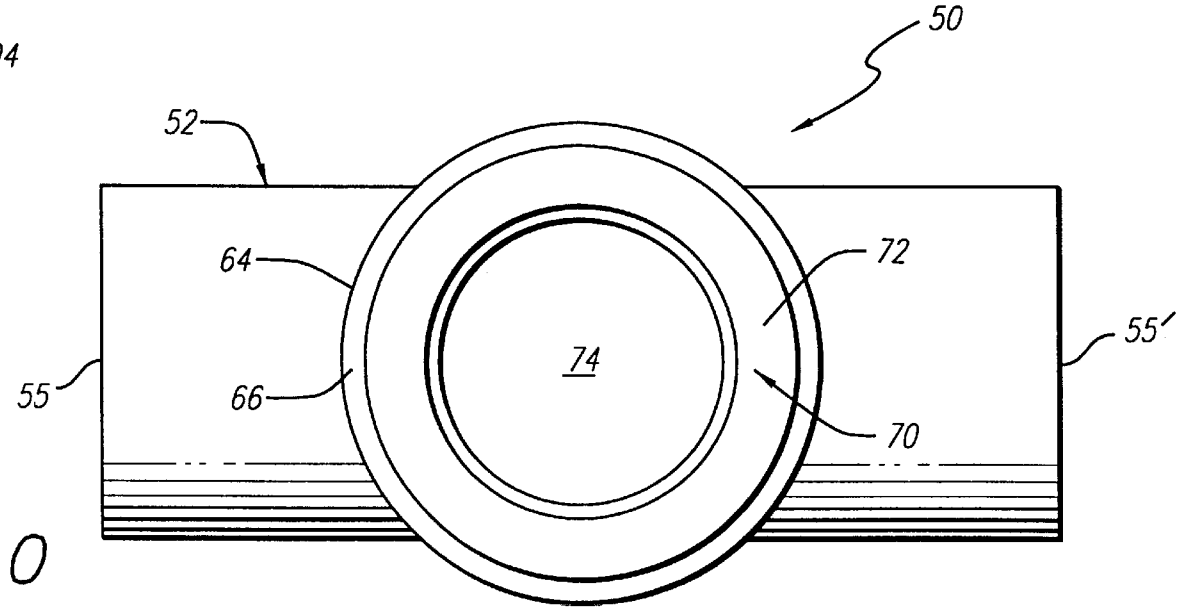
FIG. 10 is a top plan view taken alone the plane of line 10—10 of FIG. 7.

The frangible membrane 70 is maintained in place, in covering relation to the open end 62, by a fitting 80 having a lower annular face 82 which opposes the flange 64, sandwiching the rim 72 of the frangible membrane 70 therebetween, as seen in FIG. 7. The O-ring 67 absorbs pressure to prevent the frangible membrane 70 from cracking as the fitting 80 is advanced towards the flange 64 and against the rim 72 of the frangible membrane 70. A female coupling 84 is provided to facilitate attachment of the fitting 80 to the base unit 52, enabling threaded advancement and withdrawal of the fitting 80 relative to the flange 64 and frangible membrane 70. Threads 85 about the outer periphery of the fitting 80 intermesh with corresponding threads 86 on the inner face of the female coupling 84. An inwardly directed flange 87 on the lower open end of the female coupling 84 engages the underside of the flange 64 of the vent port. The fitting 80 further includes a flat ledge 88 which proceeds inward to a reduced diameter extension 89. The fitting 80 is open at both the opposite ends and has a larger diameter between the annular face 82 compared to a top open end 90. The ledge 88 on the fitting 80 is provided with a plurality of air inlet holes 94 which extend from the top ledge 88 through the thickness of the fitting 80 to provide air flow communication between the exterior atmosphere and an inner chamber 96 above the frangible membrane 70. Once the frangible membrane 70 disintegrates, air from atmosphere enters through the air inlet holes 94 and through the top opening 62 of the vent port 60 and throughout the suction intake lines of the system to eliminate the vacuum.

Figure 9:
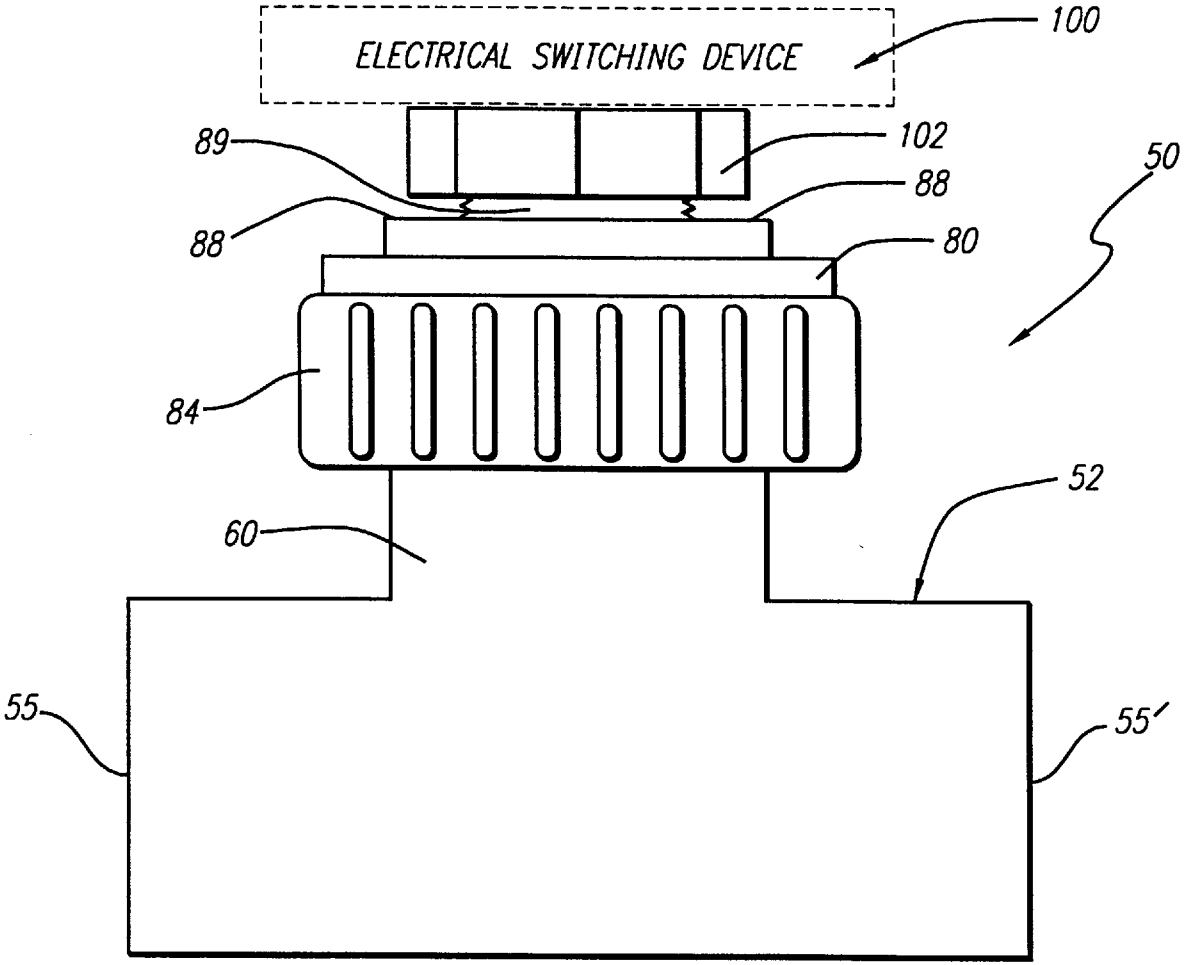
FIG. 9 is an elevational view of the safety device of the embodiment of FIG. 7.

An electrical switching device 100 can be fitted to the fluid vacuum safety coupling 50, as shown in FIGS. 7 and 9. To facilitate attachment of the electrical switching device 100, a female coupling 102 can be fitted to the device 100 for threaded engagement with an exterior threaded surface 91 on the reduced diameter extension 89 of the fitting 80. The bottom portion of the electrical switching device 100 has a sensing assembly 104 which extends through the open end 90 of the fitting 80. The sensor assembly 104 may be provided with a plunger or rod 106 which extends downwardly so that a distal end thereof engages a top surface of the frangible membrane 70. A biasing element within the device 100 may be used to urge the plunger 106 downwardly against the frangible membrane 70. This plunger 106 serves as an indicator to the electrical switching device 100, indicating the status of the frangible membrane 70. Disintegration of the frangible membrane 70 results in further downward extension of the plunger 106, thereby activating the electrical switching device 100.

The electrical switching device 100 may trigger an audible alarm housed within the device 100 and/or at a remote location via a hard wired or wireless connection. The electrical switching device 100 can further be used to shut off the pump 24. Still further, the electrical switching device 100 can be used to activate virtually any electronic component to perform a desired function once the frangible membrane 70 is shattered.

While the instant invention has been shown and described in accordance with preferred embodiments thereof, representing a best mode of the invention at the time of filing of the application for patent, it is recognized that variations, modifications and changes may be made to the instant disclosure without departing from the spirit and scope of the invention, as set forth in the following claims and within the doctrine of equivalents.

What is claimed is:

1. A device for use in a fluid transfer system having a pump which draws water from a reservoir through one or more intake lines each extending from an open end at the reservoir to an intake of the pump;

said device comprising:

means for sensing negative pressure in the fluid transfer system;

means for analyzing the sensed negative pressure including comparing the sensed negative pressure to a predetermined range of negative pressure level values; and vacuum pressure relief means actuated in response to said sensed negative pressure being at a negative pressure level value that is outside of the predetermined range for introducing positive pressure to the one or more intake lines of the system, thereby eliminating suction at the open end of the one or more intake lines;

means for disabling the pump to prevent continued operation thereof upon the sensed negative pressure being at a negative pressure level value that is outside of the predetermined range;

control means communicating with said sensing means, said analyzing means, and said vacuum pressure relief means for triggering actuation of said vacuum pressure relief means;

wherein:

said vacuum pressure relief means include a vacuum breaker structured and disposed to introduce air from atmosphere to said one or more intake lines upon actuation thereof;

said control means includes relay means for selectively directing electric current flow to said vacuum pressure relief means for actuation thereof upon the sensed negative pressure being at a negative pressure level value that is outside of the predetermined range;

said relay means is further structured to selectively direct and interrupt electric current flow to the pump to disable the pump upon the sensed negative pressure being at a negative pressure level value that is outside of the predetermined range.

2. A device as recited in claim 1 further including indicator means for indicating detection of the sensed negative pressure being at a negative pressure level value outside of the predetermined range; and wherein said relay means is further structured to selectively direct electric current flow to one or more indicator means for indicating detection of the sensed negative pressure being at a negative pressure level value that is outside of the predetermined range.

3. A device as recited in claim 2 wherein said indicator means includes at least one audible alarm device.

4. A device as recited in claim 2 wherein said indicator means includes at least one visual alarm device.

5. A device for use in a fluid transfer system having a pump which draws water from a reservoir through one or more intake lines each extending from an open end at the reservoir to an intake of the pump;

said device comprising:

means for sensing negative pressure in the fluid transfer system;

means for analyzing the sensed negative pressure in relation to a predetermined range of negative pressure levels;

vacuum pressure relief means actuated in response to said sensed negative pressure being at a negative pressure level outside of the predetermined range for introducing positive pressure to the one or more intake lines of the system, thereby eliminating suction at the open ends thereof; and control means communicating with said sensing means, said analyzing means, and said vacuum pressure relief means for triggering actuation of said vacuum pressure relief means upon determining that said sensed negative pressure is at a level outside of the predetermined range;

wherein:

said analyzing means includes means for selectively setting the predetermined range of negative pressure levels;

said control means is structured and disposed for disabling the pump to prevent continued operation thereof upon detection of the sensed negative pressure being at a negative pressure level value that is outside of the predetermined range;

said control means is structured and disposed for actuating one or more indicator means for indicating detection of the sensed negative pressure being at a level outside of the predetermined range, actuation of said vacuum pressure relief means, and disabling of the pump.

6. A device for use in a fluid transfer system having a pump which draws fluid from a reservoir through one or more intake lines each extending from an open end at the reservoir to an intake of the pump;

said device comprising:

means for selecting an operational range of negative pressure level values;

means for sensing negative pressure in the fluid transfer system;

means for analyzing the sensed negative pressure to determine if said sensed negative pressure is at a negative pressure level value within the selected operational range;

vacuum pressure relief means for introducing positive pressure into the intake lines of the system to thereby remove suction at the open ends of the intake lines upon activation thereof; and trigger means for actuating said vacuum pressure relief means upon said sensed negative pressure level being at a negative pressure level value that is outside of the selected operational range; wherein said vacuum pressure relief means include a vacuum breaker structured and disposed to introduce air from atmosphere to said one or more intake lines upon actuation thereof.

* * * * *